US011085692B2

(12) United States Patent
Okazaki et al.

(10) Patent No.: US 11,085,692 B2
(45) Date of Patent: Aug. 10, 2021

(54) MAGNETIC GASKET AND COOLING APPARATUS

(71) Applicant: PANASONIC CORPORATION, Osaka (JP)

(72) Inventors: Toru Okazaki, Osaka (JP); Masanori Minamio, Osaka (JP); Terutsugu Segawa, Osaka (JP); Yasuhiro Asaida, Kyoto (JP); Fumihiko Kawai, Osaka (JP); Fuminori Takami, Osaka (JP)

(73) Assignee: PANASONIC CORPORATION, Osaka (JP)

( * ) Notice: Subject to any disclaimer, the term of this patent is extended or adjusted under 35 U.S.C. 154(b) by 56 days.

(21) Appl. No.: 16/456,541

(22) Filed: Jun. 28, 2019

(65) Prior Publication Data

US 2020/0003481 A1 Jan. 2, 2020

(30) Foreign Application Priority Data

Jun. 29, 2018 (JP) ..... JP2018-124469
May 13, 2019 (JP) ..... JP2019-090598

(51) Int. Cl.

| | |
|---|---|
| ***F25D 23/08*** | (2006.01) |
| ***E06B 7/23*** | (2006.01) |
| ***F25D 21/04*** | (2006.01) |
| ***E05C 19/16*** | (2006.01) |

(52) U.S. Cl.

CPC ..... *F25D 23/087* (2013.01); *E05C 19/161* (2013.01); *E06B 7/23* (2013.01); *F25D 21/04* (2013.01); *E05Y 2900/31* (2013.01)

(58) Field of Classification Search

CPC ..... F25D 23/087; F25D 21/04; A47F 3/043; E05C 19/161; Y10S 292/71
USPC ..... 49/478.1
See application file for complete search history.

(56) References Cited

U.S. PATENT DOCUMENTS

| | | | | |
|---|---|---|---|---|
| 3,048,902 | A * | 8/1962 | Hastings | E05C 19/161 49/402 |
| 2009/0058246 | A1* | 3/2009 | Cittadini | F25D 23/087 312/405 |
| 2013/0247472 | A1* | 9/2013 | Mentasti | F25D 23/087 49/478.1 |
| 2018/0328648 | A1* | 11/2018 | Adachi | C08J 9/0085 |
| 2019/0178434 | A1* | 6/2019 | Sakatani | C04B 18/022 |

FOREIGN PATENT DOCUMENTS

| | | |
|---|---|---|
| JP | 2005-188840 | 7/2005 |
| JP | 2009-109053 | 5/2009 |
| JP | 2011-237117 | 11/2011 |
| JP | 2011237117 | * 11/2011 |

* cited by examiner

*Primary Examiner* — Frantz F Jules
*Assistant Examiner* — Rodrigo Royo
(74) *Attorney, Agent, or Firm* — Wenderoth, Lind & Ponack, L.L.P.

(57) ABSTRACT

The cooling apparatus includes: a thermal insulation box; a door; and a magnetic gasket, the magnetic gasket having: a magnet; a magnet retaining part; and a heat insulation sheet being provided between the magnet and the magnet retaining part and being provided, in a closed state in which the opening is closed by the door, on a side portion on a side of the door on a peripheral surface of the magnet and on a side portion facing an inner side in a width direction in the closed state on the peripheral surface of the magnet.

6 Claims, 6 Drawing Sheets

| | DETAILED VIEW OF M PORTION | HEAT INSULATION SHEET INSTALLATION SURFACE | | | | QUANTITY OF HEAT ENTERING INSIDE OF COMPARTMENT |
|---|---|---|---|---|---|---|
| | | COMPARTMENT INNER SIDE SIDE SURFACE (31a) | COMPARTMENT OUTER SIDE SIDE SURFACE (31d) | DOOR SIDE PLANE SURFACE (31b) | COMPARTMENT OUTER SIDE SIDE SURFACE (31c) | |
| 1 |  | | | | | 100 |
| 2 |  | ○ | ○ | ○ | ○ | 94 |
| 3 |  | ○ | ○ | ○ | | 96 |
| 4 |  | ○ | | ○ | | 96 |
| 5 |  | | | ○ | | 99 |

MAGNETIC GASKET AND COOLING APPARATUS

CROSS REFERENCE TO RELATED APPLICATIONS

This application is entitled to and claims the benefit of Japanese Patent Application No. 2018-124469, filed on Jun. 29, 2018, and Japanese Patent Application No. 2019-90598, filed on May 13, 2019, the disclosures of which including the specifications, drawings and abstracts are incorporated herein by reference in their entirety.

TECHNICAL FIELD

The present invention relates to a magnetic gasket and a cooling apparatus including the magnetic gasket on a peripheral portion of a door on a compartment inner side.

BACKGROUND ART

In a refrigerator, in order to thermally insulate an inside of the refrigerator (hereinafter, also referred to as a "compartment inner side") and to keep a temperature thereinside at a low temperature, it is needed to prevent cold air on the compartment inner side from leaking to a compartment outer side and to prevent outside air from entering from an outside of the refrigerator (hereinafter, also referred to as a "compartment outer side") to the compartment inner side. Because of this, it is required to retain a state in which with the door closed, an opening end surface of a thermal insulation box serving as a storage part and a peripheral portion of the door, which contacts this opening end surface, are closely attached to each other over the entire periphery. Therefore, in the refrigerator, in general, a magnetic gasket having flexibility is attached on the peripheral portion of the door on the compartment inner side, and with the door closed, the thermal insulation box and the door are closely attached by a magnetic force of the magnetic gasket.

Since unlike other household electrical appliances, the refrigerator is daily continuously operated, energy saving is extremely strongly demanded for the refrigerator. Therefore, as to the magnetic gasket, the thermal insulation box and the door are devised to be closely attached over the entire periphery, and preventing heat from being transmitted from the magnetic gasket to the compartment inner side is devised.

For example, there have been disclosed a variety of structures, in each of which a magnet of a magnetic gasket attached onto a door is caused to directly contact an opening end surface of a thermal insulation box, thereby strengthening a magnetic force (attractive force) exerted on the opening end surface and further ensuring close attachment of the door and the thermal insulation box (for example, refer to Patent Literature 1).

FIG. 7 is a cross-sectional view of a principal part, illustrating a state of close attachment of a door and an opening end surface of a thermal insulation box, disclosed in Patent Literature 1. The thermal insulation box shown in FIG. 7 is a refrigerator main body, which is constituted of outer box 70, inner box 72, and thermal insulation material 71 filled between outer box 70 and inner box 72. Magnetic gasket 60 is attached onto a peripheral portion of a back surface (a side facing the opening end surface of the thermal insulation box) of door 50, whereas flange part 72*a* formed of a magnetic material is provided onto the periphery of a front surface (an opening end surface) of outer box 70.

Magnetic gasket 60 is attached to flange part 72*a* through attraction, thereby closely attaching door 50 and the thermal insulation box via magnetic gasket 60. Thus, a space between door 50 and outer box 70 is effectively sealed, and storage chamber 80 (compartment inner side) and an outside are thermally insulated. Further, heat transfer between the compartment inner side and the compartment outer side is suppressed by thermal insulation material 71 filled between outer box 70 and inner box 72. By employing the above-described configuration, a temperature inside storage chamber 80 is retained at a predetermined temperature.

Door 50 includes door inner plate 51, fitting recessed groove 52, and thermal insulation material 71, and inside the thermal insulation box, refrigerant pipe 90 is disposed in the vicinity of outer box 70.

Here, magnetic gasket 60 is configured to include magnet retaining part 61, magnet 62, attaching part 63, and saclike part 64 connecting magnet retaining part 61 and attaching part 63.

Instead of a conventional saclike part into which a string-like magnet is inserted, magnet retaining part 61 has an open surface on a side of the thermal insulation box, which serves as an attraction surface, and a U-shaped cross section. In magnet retaining part 61, a wedge-shaped projection is integrally formed so as to extend from a U-shaped bottom surface toward magnet 62. This wedge-shaped projection is provided over the entire periphery of magnetic gasket 60.

Magnet 62 is housed inside magnet retaining part 61. Magnet 62 is disposed such that with the door closed, an outside flat surface 62*a* exposed from magnet retaining part 61 faces an end surface of the opening end surface of the thermal insulation box. In addition, on a lower surface side of magnet 62, a fitting groove whose opening (entry port) is made narrow is formed. The wedge-shaped projection of magnet retaining part 61 is engaged into this fitting groove by utilizing elasticity thereof, whereby magnet 62 is attached so as not to come off from magnet retaining part 61.

On outside flat surface 62*a* of magnet 62, two streaks of recessed grooves 62*b* are provided, and thermal conduction is suppressed by air layers of recessed grooves 62*b*. Since magnet 62 directly contacts the opening end surface of the thermal insulation box, a sufficient attractive force can be obtained without attenuation of a magnetic force.

Further, there also has been disclosed a magnetic gasket which includes a block-like thermal insulation material on a surface facing toward a compartment outer side in order to prevent heat of outside air from entering from the compartment outer side by thermal conduction of the magnetic gasket itself (for example, refer to Patent Literature 2). This magnetic gasket includes a hollow chamber and a magnet chamber on a thermal insulation box side of this hollow chamber and is configured so as to include a block-like thermal insulation material on a surface contacting air outside a wall surface of the hollow chamber. By employing the above-described configuration, both heat transmitted by thermal conduction and convection of air inside the hollow chamber and heat transmitted by the magnetic gasket itself are insulated by the thermal insulation material, thereby suppressing transmission of the heat to a compartment inner side. Thus, a cooling efficiency for cooling an inside of a thermal insulation box can be enhanced.

In addition, in another prior example, there also has been disclosed a configuration of a magnetic gasket in which an air layer is disposed between a magnet and a magnet retaining part in order to prevent heat of an outside from entering from the vicinity of the magnet of the magnetic gasket of a door to a compartment inner side (for example, refer to Patent Literature 3). A refrigerator disclosed in Patent Literature 3 has a refrigerator main body, a door, and a magnetic gasket on a peripheral portion of the door. This magnetic gasket includes an attaching part attached to the door, a magnet retaining part which retains the magnet thereinside, and a flexible part which connects the attaching part and the magnet retaining part in an extensible and contractible manner. This magnetic gasket is characterized in that inside the magnet retaining part, the air layer is formed between the magnet and an inner peripheral surface of the magnet retaining part.

Thus, while a magnetic force of an attraction surface portion of the magnet is being retained, the magnet can be downsized, and entry of heat, which is transmitted to the magnet, to a compartment inner side through the magnet retaining part can be reduced.

CITATION LIST

Patent Literature

PTL 1
Japanese Patent Application Laid-Open No. 2005-188840
PTL 2
Japanese Patent Application Laid-Open No. 2009-109053
PTL 3
Japanese Patent Application Laid-Open No. 2011-237117

SUMMARY OF INVENTION

Technical Problem

Since in the magnetic gasket described in Patent Literature 1 shown in FIG. 7, magnet 62 is closely attached directly to the opening end surface of the thermal insulation box, a large magnetic force is exerted on the thermal insulation box, thereby obtaining effect to increase an attractive force between magnetic gasket 60 and the thermal insulation box. However, since magnet 62 directly contacts the opening end surface of the thermal insulation box, it is likely that in accordance with an increase in the number of times at which the door 50 is opened and closed, magnet 62 is chipped (damaged). Further, dust easily accumulates in recessed grooves 62*b* of magnet 62, and when magnet 62 is brought into contact with the opening end surface of the thermal insulation box, a gap is caused between magnet 62 and the opening end surface of the thermal insulation box by the dust, and thermal insulation performance is thereby easily reduced. In addition, it is also likely that magnet 62 is detached from magnet retaining part 61 due to long-term use.

Since the magnetic gasket described in Patent Literature 2 includes the block-like thermal insulation material on a surface which contacts air outside a wall surface of the hollow chamber, transfer of heat between the compartment outer side and the compartment inner side is blocked by this block-like thermal insulation material. Accordingly, a thermal efficiency of the refrigerator can be enhanced. However, the thermal insulation material is thicker than a gasket member (that is, a portion in which the magnet and the thermal insulation material are excluded from the magnetic gasket) and has higher stiffness than the gasket member, flexibility of the magnetic gasket as a whole is reduced. Because of this, it is likely that the magnetic gasket is hardly attached evenly and closely onto the opening end surface of the thermal insulation box over the entire periphery. Therefore, thermal insulation performance attained by the magnetic gasket may become insufficient.

Since in the magnetic gasket described in Patent Literature 3, the air layer is formed between the magnet and the magnet retaining part, heat transferred from an opening portion of the thermal insulation box to the magnet is insulated by this air layer. Accordingly, heat entering from the compartment outer side via the magnetic gasket can be suppressed. However, when an air layer part is disposed inside the magnet retaining part, it is required to increase a thickness of the magnetic gasket as a whole or to decrease a thickness of the magnet. If the thickness of the magnetic gasket is increased, a gap between the thermal insulation box and the door becomes large, and outside air easily enters the compartment inner side and cold air easily flows out from the compartment inner side to the compartment outer side. On the other hand, if the thickness of the magnet is decreased, because a magnetic force is weakened, it becomes difficult to closely attach the magnetic gasket onto the opening end surface of the thermal insulation box in an even manner. Therefore, thermal insulation performance attained by the magnetic gasket may become insufficient.

The present disclosure is to solve the above-described problems of the conventional art, and an object of the present disclosure is to enable enhancement in thermal insulation performance of a magnetic gasket and a cooling apparatus.

Solution to Problem

A cooling apparatus according to one aspect of the present disclosure includes: a thermal insulation box that has a housing space with an opening in front and an opening end surface enclosing the opening and facing frontward; a door capable of opening and closing the opening, the door being attached to the thermal insulation box; and a magnetic gasket attached to an inside peripheral portion of the door facing the opening end surface while the opening is closed, the magnetic gasket including: a magnet; a magnet retaining part that retains the magnet; and a heat insulation sheet being provided between the magnet and the magnet retaining part and being provided, in a closed state in which the opening is closed by the door, on a side portion on a side of the door on a peripheral surface of the magnet and on a side portion facing an inner side in a width direction in the closed state on the peripheral surface of the magnet.

A magnetic gasket according to one aspect of the present disclosure includes: a magnet; a magnet retaining part retaining the magnet; and a heat insulation sheet being provided between the magnet and the magnet retaining part.

A cooling apparatus according to one aspect of the present disclosure includes: a thermal insulation box that has a housing space with an opening in front and an opening end surface enclosing the opening and facing frontward; a door capable of opening and closing the opening, the door being attached to the thermal insulation box; and the magnetic gasket according to claim 1 attached to an inside peripheral portion of the door facing the opening end surface while the opening is closed.

Advantageous Effects of Invention

According to the present disclosure, enhancement in thermal insulation performance can be attained by a magnetic gasket.

DESCRIPTION OF EMBODIMENTS

Figure 1:
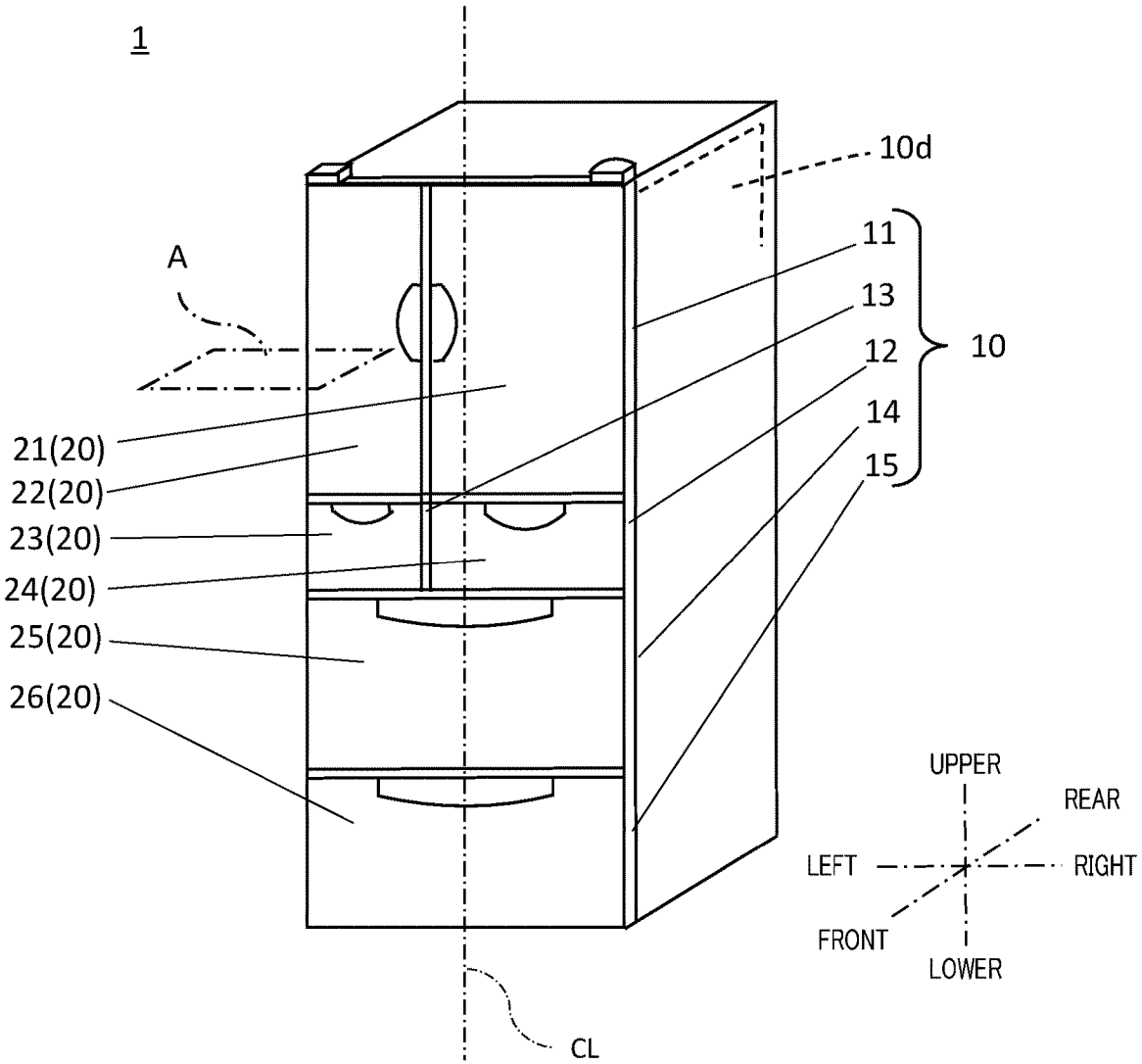
FIG. 1 is a schematic perspective view of a refrigerator according to an embodiment of the present disclosure.

Hereinafter, a magnetic gasket and a refrigerator according to an embodiment of the present disclosure will be described with reference to the accompanying drawings. The embodiment described hereinafter is merely an example, and a variety of modifications and applications of technology which are not specified in the below embodiment are not excluded. In addition, components of the embodiment can be modified to be implemented without departing from the scope of these. Further, the components of the embodiment can be selected as needed or can be appropriately combined.

Note that in all of the drawings for describing the embodiment, as a matter of principle, the same components are denoted by the same reference numerals and signs, and the description therefor may be omitted.

[1. Configuration]

In the below description, a side on which doors 21 to 26 are present is defined to be the front and a side opposite to the front is defined to be the rear. In addition, with reference to a case in which the refrigerator is viewed from the front toward the rear, the right and left are defined. Both directions of a right direction and a left direction are collectively referred to as a width direction. In addition, a direction approaching center CL in the width direction is referred to as a width direction inside, and a direction away from center CL in the width direction is referred to as a width direction outside.

[1-1. Configuration of Refrigerator]

Hereinafter, with reference to FIG. 1, an overall configuration of refrigerator 1 will be described. FIG. 1 is a schematic perspective view of refrigerator 1 (a cooling apparatus) according to the embodiment of the present disclosure.

Refrigerator 1 includes thermal insulation box 10 provided with a housing space 10*d* (hereinafter, also referred to as a "compartment inner side") formed thereinside and an opening in front; a plurality of doors 21 to 26 which are attached onto this thermal insulation box 10 so as to be openable and closable; and the later-described magnetic gaskets 30 which are disposed on inside peripheral portions of these doors 21 to 26. Compartment inner side 10*d* is partitioned by partition plates (not shown) into refrigerating chamber 11, second freezing chamber 12, ice-making chamber 13, first freezing chamber 14, and vegetable chamber 15.

The inside peripheral portions of doors 21 to 26 refer to outer peripheral borders of surfaces which face compartment inner side 10*d* with doors 21 to 26 closed. More specifically, the inside peripheral portions of doors 21 to 26 refer to, with doors 21 to 26 closed, portions which face an opening end surface 10A of thermal insulation box 10, the later-described refrigerating chamber 11, second freezing chamber 12, ice-making chamber 13, first freezing chamber 14, and vegetable chamber 15 (that is, a peripheral surface of an opening, refer to FIG. 2) via magnetic gaskets 30.

In the below description, when doors 21 to 26 are not particularly discriminated, doors 21 to 26 are written as door 20.

Thermal insulation box 10 is configured to include refrigerating chamber 11 in an uppermost portion thereof; second freezing chamber 12 and ice-making chamber 13 which are disposed side by side in a portion below refrigerating chamber 11; first freezing chamber 14 further therebelow; and vegetable chamber 15 disposed in a lowermost portion thereof.

Note that although in the present embodiment, the configuration in which refrigerating chamber 11, second freezing chamber 12, ice-making chamber 13, first freezing chamber 14, and vegetable chamber 15 are disposed as described above is employed, the present disclosure is not limited to the above-described configuration. It is needless to say that the present disclosure is applicable to, for example, a refrigerator having only a refrigerating chamber, a refrigerator having only a freezing chamber, a refrigerator having a refrigerating chamber and only one freezing chamber or three or more freezing chambers, and the like, and as long as a refrigerator is an apparatus which houses, refrigerates, and stores refrigerated goods, the present disclosure is applicable thereto without any limitation.

Each of refrigerating chamber 11, second freezing chamber 12, ice-making chamber 13, first freezing chamber 14, and vegetable chamber 15 has an opening as described above. At each opening, door 20 is disposed. For example, refrigerating chamber 11 has rotary-type refrigerating chamber right door 21 and refrigerating chamber left door 22 and has a structure which is opened in a double-door manner. Inside refrigerating chamber 11, a refrigerating chamber shelf (not shown) and a refrigerating chamber case (not shown) are provided. Second freezing chamber 12, ice-making chamber 13, first freezing chamber 14, and vegetable chamber 15 are drawer-type housing chambers, and are provided with second freezing chamber door 24, ice-making chamber door 23, first freezing chamber door 25, and vegetable chamber door 26 in an integrated manner, respectively.

A temperature in refrigerating chamber 11 is set to be in a range of approximately 1° C. to 5° C. which is a refrigerating temperature zone for refrigerating storage, in which freezing does not occur. A temperature in vegetable chamber 15 is set to be in a range of approximately 2° C. to 7° C. which is a vegetable temperature zone which is equivalent to or is slightly higher than the refrigerating temperature zone in refrigerating chamber 11. A temperature in first freezing chamber 14 is ordinarily set to be in a range of approximately −22° C. to −15° C. for freezing storage. However, when it is desired that a state in which housed goods are frozen and stored is further enhanced, the temperature therein can also be set at a lower temperature, for example, in a range of approximately −30° C. to −25° C.

A temperature in second freezing chamber 12 is set to be in a range of −20° C. to −12° C. which is equivalent to or is slightly higher than the freezing temperature zone in first freezing chamber 14. Ice-making chamber 13 uses water sent from a water storage tank (not shown) inside refrigerating chamber 11, makes ice by an automatic ice-maker (not shown) provided in an upper portion of ice-making chamber 13, and stores the ice.

Note that the above-mentioned set temperature ranges in refrigerating chamber 11, second freezing chamber 12, ice-making chamber 13, first freezing chamber 14, and vegetable chamber 15 are cited as exemplary ranges, and temperature ranges in the present invention are not limited thereto and are set appropriately in accordance with respective use modes.

In refrigerator 1, a machine chamber (not shown) is provided. In this machine chamber, components on a high pressure side of a refrigeration cycle such as a compressor and a dryer for removing moisture are housed. The refrigeration cycle is formed by a series of refrigerant passages which include a compressor (not shown), condenser (not shown), a capillary tube (not shown) which is a decompressor, and a cooler (not shown) provided in the order mentioned. As a refrigerant, for example, isobutane which is a hydrocarbon-based refrigerant is sealed into the refrigerant passages.

Note that a configuration of the refrigeration cycle in refrigerator 1 of the present disclosure is not limited to the above-described configuration, and as long as a configuration thereof generates cold air in temperature rages required for refrigerating and freezing, any configuration can be employed.

[1-2. Principal Part of Refrigerator and Configuration of Magnetic Gasket]

Figure 2:
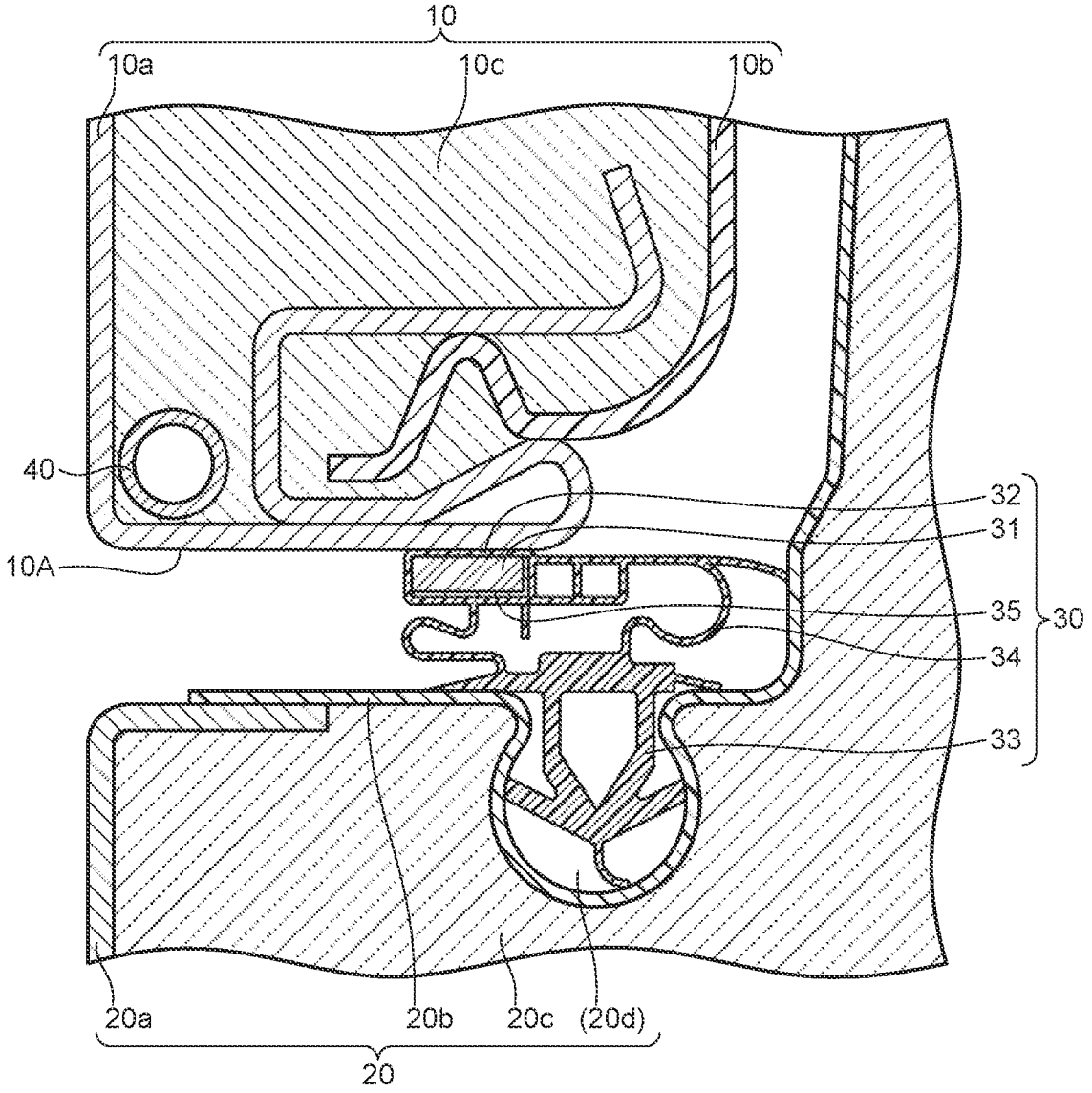
FIG. 2 is a diagram illustrating a structure of a portion which includes a thermal insulation box, a magnetic gasket, and a door in the refrigerator according to the present embodiment and is a cross-sectional view of a principal part, along surface A shown in FIG. 1.
Figure 3:
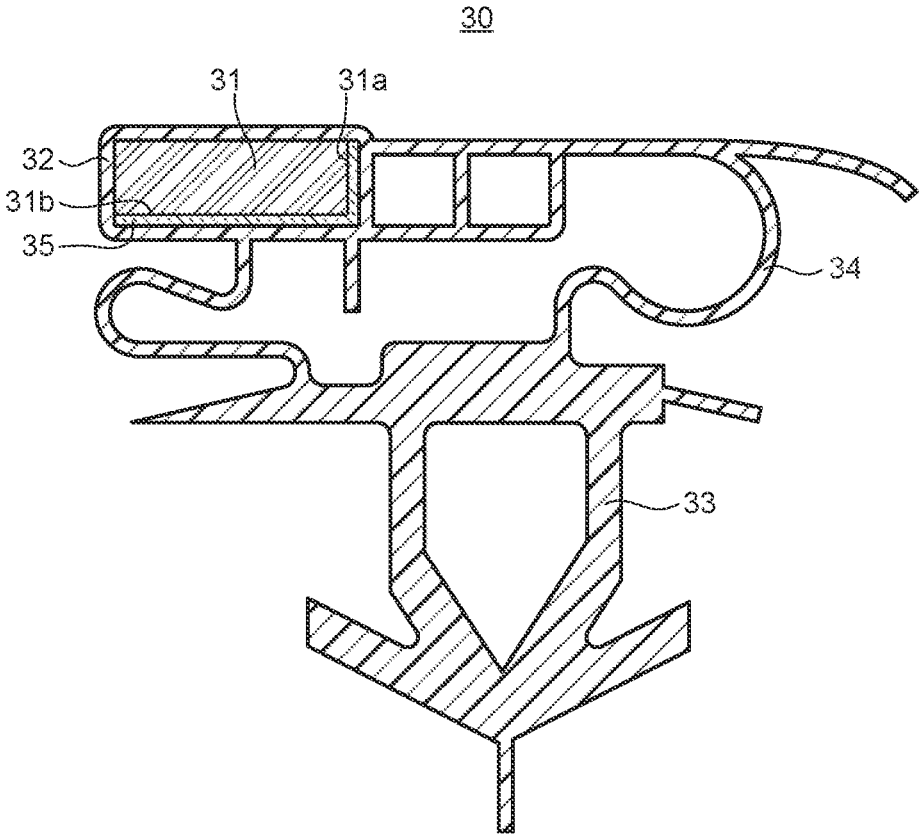
FIG. 3 is a diagram illustrating a structure of the magnetic gasket in the refrigerator according to the present embodiment and is a cross-sectional view of the magnetic gasket which is cut in a direction perpendicular to a longitudinal direction.
Figure 4:
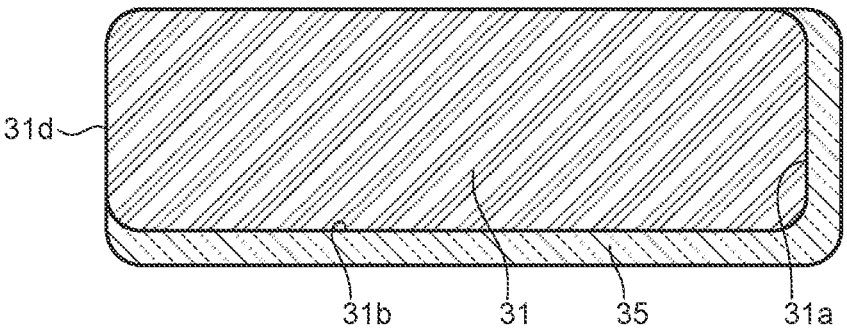
FIG. 4 is a diagram illustrating a state in which a magnet and a heat insulation sheet are stuck to each other in the refrigerator according to the present embodiment and is a cross-sectional view of the stuck magnet and heat insulation sheet which are cut in a direction perpendicular to a longitudinal direction.

Hereinafter, with reference to FIGS. 2 to 4, a principal part of refrigerator 1 and a configuration of magnetic gasket 30 will be described. FIG. 2 is a diagram illustrating a structure of a portion which includes thermal insulation box 10, magnetic gasket 30, and door 20 in refrigerator 1 according to the present embodiment and is a cross-sectional view of a principal part, along surface A indicated by a dot-and-dash line in FIG. 1. FIG. 3 is a diagram illustrating a structure of magnetic gasket 30 in refrigerator 1 according to the present embodiment and is a cross-sectional view (traverse cross-sectional view) of magnetic gasket 30 which is cut in a direction perpendicular to a longitudinal direction (in which magnetic gasket 30 extends). FIG. 4 is a diagram illustrating a state in which a magnet and a heat insulation sheet are stuck to each other in refrigerator 1 according to the present embodiment and is a cross-sectional view of the stuck magnet and heat insulation sheet which are cut in a direction perpendicular to a longitudinal direction.

As shown in FIG. 2, thermal insulation box 10 is configured to include outer box 10*a* formed of a magnetic material (for example, a steel plate), inner box 10*b* molded of resin such as an ABS resin, and heat insulation member 10*c* such as hard foamed polyurethane resin, with which a space between outer box 10*a* and inner box 10*b* is filled while heat insulation member 10*c* is being foamed.

In refrigerator 1, when refrigerating chamber 11 (refer to FIG. 1) and the like are cooled, outer box 10*a* is also partially cooled and dew may condense on outer box 10*a*. In order to prevent this, as shown in FIG. 2, inside outer box 10*a*, heat radiation pipe 40 serving as a heat source is disposed.

Note that heat insulation member 10*c* is not limited to resin such as the foamed polyurethane resin. As heat insulation member 10*c*, as long as a material thereof has heat insulation properties, a material, for example, vacuum thermal insulation material or the like can be appropriately used.

In addition, as shown in FIG. 2, each door 20 is configured to include door outer panel 20*a*, door inner plate 20*b* formed of, for example, an ABS resin, and heat insulation member 20*c* formed of hard urethane foam or the like, with which a space between door outer panel 20*a* and door inner plate 20*b* is filled while heat insulation member 20*c* is being foamed. Further, in each door 20, fitting groove 20*d* for fixing attaching part 33 of magnetic gasket 30 in an engaged manner is also formed by denting door inner plate 20*b*.

Note that as with heat insulation member 10*c* used in thermal insulation box 10, a material of heat insulation member 20*c* is not limited to resin such as foamed polyurethane. For example, as the material of heat insulation member 20*c*, a vacuum thermal insulation material or the like may be used.

As shown in FIG. 2, on a peripheral portion on a storage chamber side of each door 20, in order to prevent cold air from leaking and heat of outside air from entering by sealing up a gap between door 20 and thermal insulation box 10, magnetic gasket 30 which is produced by extrusion-molding soft resin such as polyvinyl chloride is provided.

This magnetic gasket 30 includes magnet 31 having flexibility, magnet retaining part 32, attaching part 33, connecting part 34 which connects magnet retaining part 32 and attaching part 33, and heat insulation sheet 35 provided on a peripheral surface of magnet 31.

Figure 7:
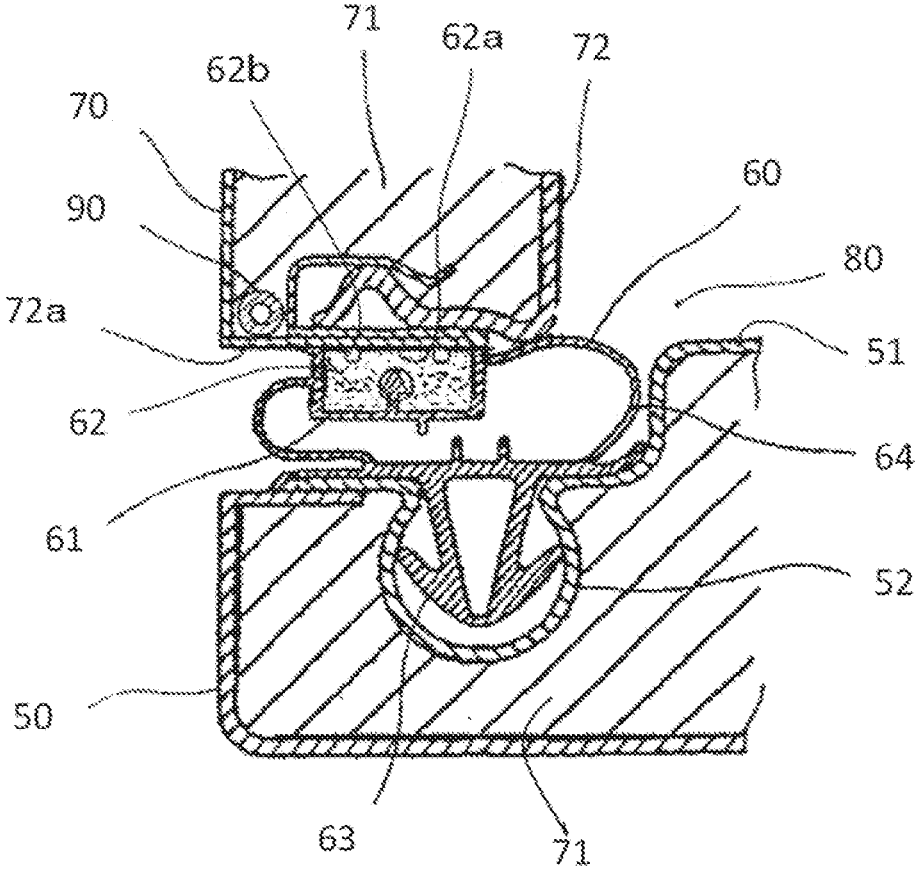
FIG. 7 PRIOR ART
FIG. 7 is a cross-sectional view illustrating one example of a configuration of the conventional gasket.

Magnet retaining part 32 retains and houses magnet 31. This magnet retaining part 32 is different from magnet retaining part 61 in Patent Literature 1, which is described with reference to FIG. 7. More particularly, magnet retaining part 32 also covers the peripheral surface of magnet 31 which faces opening end surface 10A of thermal insulation box 10, with door 20 closed. In other words, magnetic gasket 30 is configured such that magnet 31 does not directly contact opening end surface 10A.

Attaching part 33 is engaged in fitting groove 20*d* provided in door 20, thereby fixing magnetic gasket 30 to door 20. Connecting part 34 has flexibility and connects magnet retaining part 32 and attaching part 33 in an extensible and contractible manner. Heat insulation sheet 35 is provided on a surface on which at least "a surface of magnet 31, which contacts opening end surface 10A of thermal insulation box 10 via magnet retaining part 32, is excluded" from a surface of magnet 31. The reason why the surface contacting opening end surface 10A is excluded from an attachment range of heat insulation sheet 35 on magnet 31 is that a magnetic force (attractive force) exerted between magnet 31 and opening end surface 10A is prevented from being decreased by presence of heat insulation sheet 35. Note that as long as requisite minimums of sealing properties and heat insulation properties attained by door 20 are ensured, heat insulation sheet 35 may be provided on a part of the surface contacting opening end surface 10A of magnet 31.

Magnet retaining part 32, attaching part 33, and connecting part 34 are integrally configured by molding soft resin, for example, polyvinyl chloride or the like in long stringy form. Magnet 31 is by mixing, for example, magnet powder and synthetic rubber and being molded and has flexibility.

Next, with reference to FIGS. 3 and 4, a structure of magnetic gasket 30 will be described further in detail. In refrigerator 1 of the present embodiment, with magnet 31 retained in magnet retaining part 32, heat insulation sheet 35 is provided over both surfaces of compartment inner side end surface part 31*a* (compartment inner side part) and door side plane surface part 31*b* (door side part) of magnet 31.

Compartment inner side end surface part 31*a* (hereinafter, also referred to as a "compartment inner side side surface 31*a*") is a portion on an inner side in a width direction on the peripheral surface of magnet 31, with door 20 closed. Door side plane surface part 31*b* is a portion on a side of door 20 on the peripheral surface of magnet 31.

As heat insulation sheet 35, a sheet material which includes at least one of xerogel and aerogel can be used. For example, as heat insulation sheet 35, a sheet material which includes at least one of silica xerogel and silica aerogel, with nanofibers, for example, having a fiber diameter of 50 nm or less dispersed therein can be used. A bulk density of the sheet material which supports at least one of the silica xerogel and the silica aerogel is small, being 100 to 250 $kg/m^3$. In addition, since the above-mentioned sheet material densely has fine pores smaller than a mean free path of air of 68 nm, the sheet material has characteristics with which solid thermal conduction and thermal conduction due to convection of air are reduced. Because of this, this sheet material has a low thermal conductivity of 0.02 W/mK when a thickness thereof is approximately 0.1 mm. In addition, even when a pressing force is applied upon closing door 20, this sheet material hardly causes a reduction in thermal insulation performance, and consequently, deterioration of magnetic gasket 30 can be suppressed over a long period of time.

The heat insulation sheet 35 as described above is provided, between magnet 31 and magnet retaining part 32, on compartment inner side end surface part 31*a* and door side plane surface part 31*b* of magnet 31, whereby the following effects can be obtained. It can be suppressed that heat from heat radiation pipe 40 located further outside magnetic gasket 30 in a width direction is transferred via outer box 10*a* of thermal insulation box 10 to magnet 31 and is transmitted to the compartment inner side. Moreover, since heat insulation sheet 35 has sufficient thermal insulation performance even when the thickness thereof is approximately 0.1 mm, it is not required to thin magnet 31 by the thickness of heat insulation sheet 35. Accordingly, without impairing an attractive force to thermal insulation box 10, close attachment of thermal insulation box 10 to the entire periphery of outer box 10*a* can be ensured.

Figure 5A:
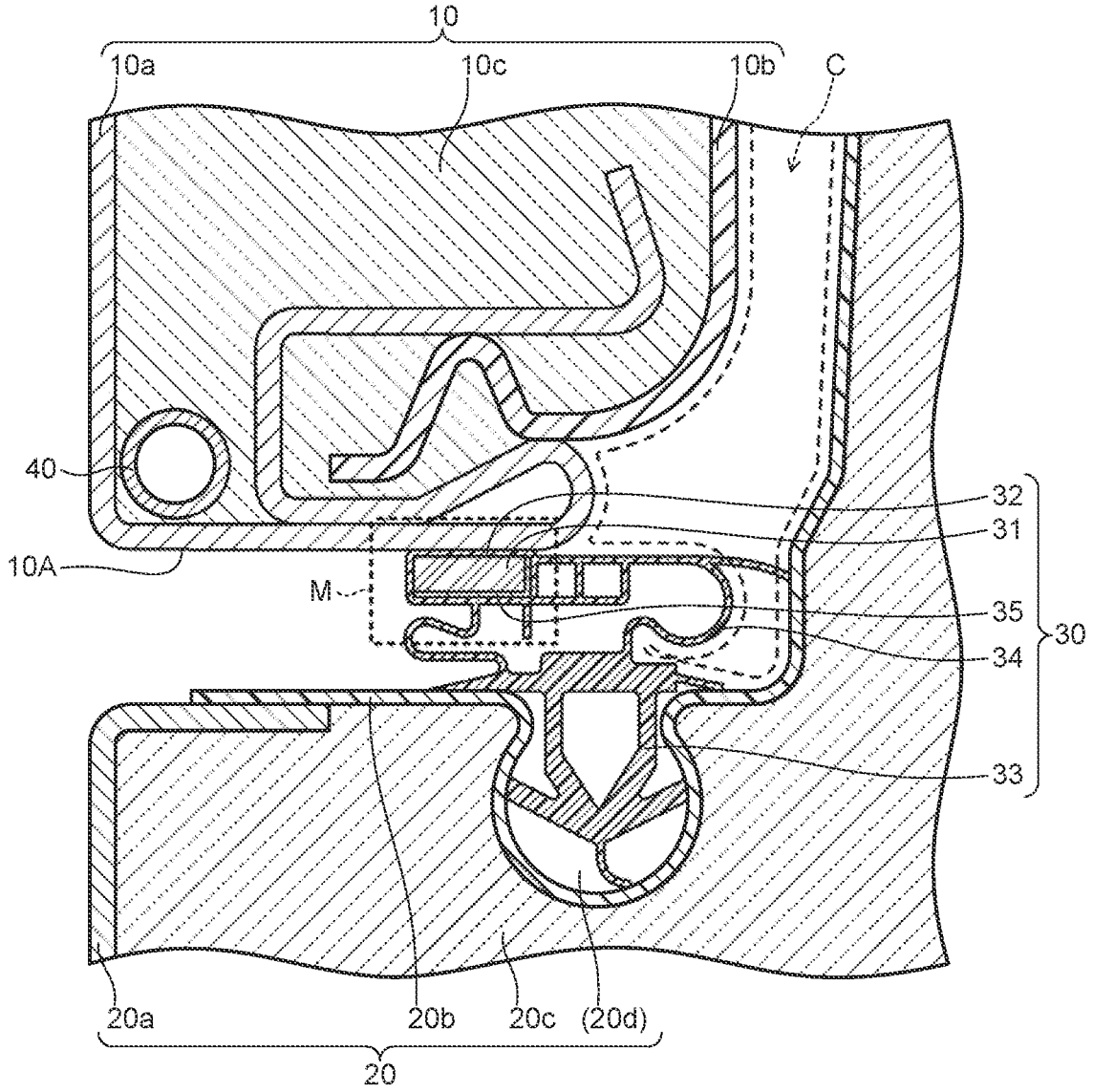
FIG. 5A is a diagram illustrating a model region in which simulation for calculating a quantity of heat entering from a peripheral portion of the gasket has been performed.
Figure 5B:
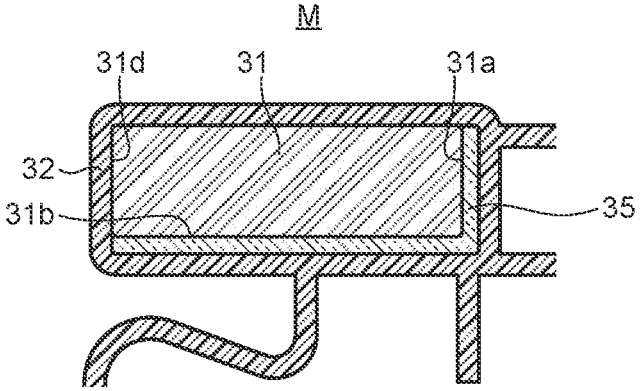
FIG. 5B is a diagram illustrating a magnet peripheral portion of the gasket in the model region in an enlarged manner.
Figure 5C:
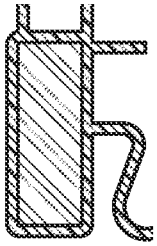
FIG. 5C is a table showing results (quantities of entering heat) of the simulation.
Figure 5C:
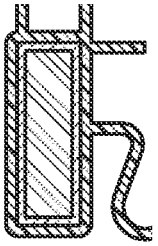
Figure 5C:
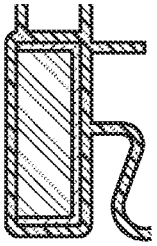
Figure 5C:
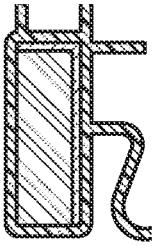
Figure 5C:
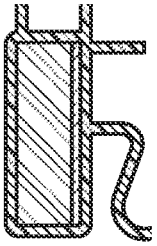

The above-described configuration allows the magnetic force (attractive force) exerted between magnet 31 and opening end surface 10A to be ensured and enables maximum enhancement in heat insulation properties of magnet 31 most inexpensively. With reference to FIGS. 5A to 5C, this will be described.

Each of FIGS. 5A to 5C shows details of calculation of a quantity of heat entering a peripheral portion of magnetic gasket 30 from the compartment outer side to the compartment inner side during operation of the refrigerator in a case in which heat insulation sheet 35 having a thickness of 0.1 mm is provided on each of the peripheral surfaces of magnet 31, by employing thermal fluid simulation. FIG. 5A is a diagram illustrating a model region in which the thermal fluid simulation has been performed. In the thermal fluid simulation, the quantity of heat entering a dotted portion (portion where the quantity of entering heat is calculated) C shown in FIG. 5A is calculated. FIG. 5B is a diagram illustrating a magnet peripheral portion M shown in FIG. 5A in an enlarged manner. FIG. 5C is a table showing results of the calculation of the quantity of heat entering the compartment inner side under respective conditions. In FIG. 5C, supposing that a quantity of heat is 100 when no heat insulation sheet 35 is provided on the periphery of magnet 31 (in the first row), when heat insulation sheet 35 is provided in respective kinds of peripheral surfaces, quantities of entering heat are shown.

When heat insulation sheet 35 is provided on all of the peripheral surfaces of magnet 31 (in the second row in FIG. 5C), a quantity of heat entering the compartment inner side is the smallest. However, in this case, on the surface contacting opening end surface 10A of thermal insulation box 10 via magnet retaining part 32, heat insulation sheet 35 is provided so as to have a thickness of 0.1 mm. Therefore, magnet 31 is 0.1 mm apart from opening end surface 10A, and the magnetic force (attractive force) is reduced. In order to compensate this reduced magnetic force by a thickness of the magnet, it is required to increase the thickness of magnet 31 by 44%, and implementing the above-mentioned configuration is unrealistic.

In addition, between when heat insulation sheet 35 is provided on three surfaces (compartment inner side side surface 31*a*, compartment outer side side surface 31*d*, and door side plane surface 31*b*) from which the surface contacting opening end surface 10A of thermal insulation box 10 via magnet retaining part 32 is excluded (in the third row in FIG. 5C) and when heat insulation sheet 35 is provided on two surfaces (compartment inner side side surface 31*a* and door side plane surface 31*b*) from which compartment outer side side surfaces 31*c* and 31*d* are excluded (in the fourth row in FIG. 5C, surfaces 31*a* and 31*b*), there is no difference in quantities of entering heat. This shows that in order to suppress transferring of heat from heat radiation pipe 40 via outer box 10*a* of thermal insulation box 10 to magnet 31 and thereby transmitting of the heat to the compartment inner side, it is sufficient to provide heat insulation sheet 35 on the compartment inner side side surface and the door side plane surface which surround magnet 31. In other words, it is shown that also for the sake of inexpensive production, providing heat insulation sheet 35 on the above-mentioned two surfaces is the most efficient.

Note that between when the heat insulation sheet is provided on one surface (door side plane surface 31*b*) (in the fifth row in FIG. 5C) and when no heat insulation sheet 35 is provided on all of the peripheral surfaces, there is not any large difference in quantities of heat entering the compartment inner side, and any configuration which enhances the heat insulation properties is not realized. Note that though it is not shown, between when heat insulation sheet 35 is provided only on compartment inner side side surface 31*a* and when no heat insulation sheet 35 is provided on all of the peripheral surfaces, similarly, there is no any large difference in quantities of heat entering the compartment inner side.

Note that as the material of heat insulation sheet 35, a material which is obtained by providing both surfaces of an aerogel layer, formed by binding aerogel particles with use of a rubber-based binder, with covering layers can also be used. Since in the above-mentioned heat insulation sheet, the aerogel particles are bound by the rubber-based binder, the heat insulation sheet is excellent in flexibility and can be bent at a small curvature radius. Note that as the aerogel, it is preferable that silica aerogel is used, in order to realize a low thermal conductivity. In addition, if an additive amount of the rubber-based binder is increased, although the flexibility of heat insulation sheet 35 can be enhanced, a thermal conductivity of heat insulation sheet 35 tends to increase. Therefore, it is preferable that the additive amount of the rubber-based binder is made as small as possible.

As a method for disposing heat insulation sheet 35 between magnet 31 and magnet retaining part 32, as shown in FIG. 4, heat insulation sheet 35 is previously fixedly bonded onto magnet 31, and thereafter, the resultant is inserted to magnet retaining part 32, thereby allowing easy manufacturing. However, the present disclosure is not limited to the above-mentioned manufacturing method, and other heretofore known methods may be employed.

[2. Operation and Effect]

(1) According to the embodiment of the present disclosure, heat insulation sheet 35 is provided on peripheral surfaces of magnet 31, thereby allowing thermal conduction from magnet 31 to magnet retaining part 32 to be suppressed without making magnet retaining part 32 and magnetic gasket 30 large. Accordingly, heat insulation properties of magnetic gasket 30 can be enhanced, and thus, entering of heat to compartment inner side 10*d* can be suppressed.

(2) Since heat insulation sheet 35 is provided on compartment inner side end surface part 31*a* and door side plane surface part 31*b* of magnet 31, transferring of heat from a compartment outer side to magnet 31 and transmitting of the heat to compartment inner side 10*d* can be efficiently suppressed.

(3) Since no heat insulation sheet 35 is provided on a side of opening end surface 10A of thermal insulation box 10, it does not occur that a magnetic force exerted on opening end surface 10A from magnet 31 is reduced. Accordingly, door 20 and opening end surface 10A of thermal insulation box 10 can be effectively attracted and attached to each other by magnetic gasket 30.

(4) Since heat insulation sheet 35 is formed of the material including xerogel or aerogel, as compared with a case in which an air layer is provided, the magnet retaining part can be made thin and transmission of heat to a compartment inner side can be efficiently suppressed.

[3. Modified Example]

(1) Although in refrigerator 1 of the present embodiment, heat insulation sheet 35 is provided on the two surfaces of door side plane surface part 31*b* and compartment inner side end surface part 31*a* of magnet 31, the present disclosure is not limited thereto. For example, heat insulation sheet 35 may be further provided on compartment outer side side surface 31*d* of magnet 31, that is, on a portion on an outside in a width direction with door 20 closed.

Figure 6:
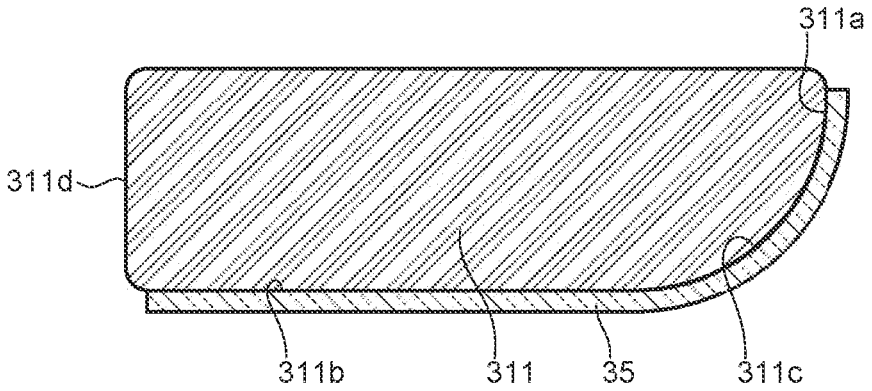
FIG. 6 is a cross-sectional view illustrating a modified example of the magnet in the refrigerator according to the present embodiment.

(2) FIG. 6 is a cross-sectional view illustrating a modified example of a magnet in refrigerator 1 according to the present embodiment. Magnet 311 in the present modified example is used, instead of magnet 31 in magnetic gasket 30 shown in FIG. 2 and FIG. 3. On this magnet 311, a curvature radius of heat insulation sheet 35 provided on peripheral surfaces is made large, thereby allowing easy close attachment of heat insulation sheet 35 onto magnet 311. Specifically, magnet 311 is provided with curved surface part 311*c* between door side plane surface part 311*b* and compartment inner side end surface part 311*a*, and heat insulation sheet 35 is bent along curved surface part 311*c*, thereby achieving a structure in which heat insulation sheet 35 is easily closely attached to magnet 311.

As described above, curved surface part 311*c* is formed between door side plane surface part 311*b* and compartment inner side end surface part 311*a*, thereby allowing heat insulation sheet 35 to be closely attached thereto along an outer peripheral surface of magnet 311 and enabling enhancement in thermal insulation performance attained by heat insulation sheet 35.

In this case, it is only required for a curvature radius of curved surface part 311*c* to be appropriately set based on a thickness and flexibility of heat insulation sheet 35. In general, the curvature radius thereof is set to be approximately the same as a thickness of heat insulation sheet 35, thereby allowing heat insulation sheet 35 to be bent along curved surface part 311*c*. For example, when the heat insulation sheet has a configuration in which silica aerogel is homogeneously embedded in voids of a fiber sheet, 0.1 mm of a thickness thereof can be realized. In the case of this thickness, it is only required to set the curvature radius of curved surface part 311*c* to be 0.1 mm or more. Note that curved surface part 311*c* may be, for example, a curved surface part which is continuous from a center position of door side plane surface part 311*b* in the width direction (a right and left direction in FIG. 5) up to an upper end portion of compartment inner side end surface part 311*a*.

Note that when also on compartment outer side end surface part 311*d*, heat insulation sheet 35 is provided, a curved surface part may be provided also between door side plane surface part 311*b* and compartment outer side end surface part 311*d*.

INDUSTRIAL APPLICABILITY

The present disclosure can contribute to energy saving by enhancing thermal insulation performance between a thermal insulation box and a door and is applicable to a variety of refrigerator fields for storing refrigerated and frozen goods.

REFERENCE SIGNS LIST

1 Refrigerator (cooling apparatus)
10 Thermal insulation box
10A Opening end surface
10*a* Outer box
10*b* Inner box
10*c* Heat insulation member
10*d* Housing space
11 Refrigerating chamber
12 Second freezing chamber
13 Ice-making chamber
14 First freezing chamber
15 Vegetable chamber
20 Door
20*a* Door outer panel
20*b* Door inner plate
20*c* Heat insulation member
20*d* Fitting groove
21 Refrigerating chamber right door
22 Refrigerating chamber left door
23 Second freezing chamber door
24 Ice-making chamber door
25 First freezing chamber door
26 Vegetable chamber door
30 Magnetic gasket
31, 311 Magnet
31*a* Compartment inner side side surface (Compartment inner side end surface part)
311*a* Compartment inner side end surface part (compartment inner side part)
31*b* Door side plane surface
311*b* Door side plane surface part (door side part)

31*c* Compartment outer side side surface
311*c* Curved surface part
31*d* Compartment outer side side surface
311*d* Compartment outer side end surface part
32 Magnet retaining part
33 Attaching part
34 Connecting part
35 Heat insulation sheet
40 Heat radiation pipe
C Portion where a quantity of entering heat is calculated
M Magnet peripheral portion

The invention claimed is:

1. A cooling apparatus, comprising:

a thermal insulation box that has a housing space with an opening in front and an opening end surface enclosing the opening and facing frontward;

a door capable of opening and closing the opening, the door being attached to the thermal insulation box; and a magnetic gasket attached to an inside peripheral portion of the door facing the opening end surface while the opening is closed, the magnetic gasket including:

a magnet;

a magnet retainer that retains the magnet; and a heat insulation sheet being provided between the magnet and the magnet retainer, wherein the magnet has a door-side flat surface which faces the door in a closed state in which the opening is closed by the door, an opening-side surface which faces the opening end surface in the closed state, and a compartment inner-side surface connecting the door-side flat surface and the opening-side surface on an inner side in a width direction of the thermal insulation box in the closed state, the compartment inner-side surface is a single curved surface which faces in a direction that gradually changes from a direction facing the door to a direction facing the opening in the closed state, the heat insulation sheet is formed from one sheet with a constant thickness, and is attached to the door-side flat surface and the opening-side surface.

2. The cooling apparatus according to claim 1, wherein the thermal insulation box includes a heat radiator embedded therein, the heat radiator being located on an outer side in the width direction of the magnet in the closed state.

3. The cooling apparatus according to claim 1, wherein, the compartment inner-side surface has the largest radius of curvature on the peripheral surfaces of the magnet.

4. The cooling apparatus according to claim 1, wherein the heat insulation sheet is formed of a material including xerogel or aerogel.

5. The cooling apparatus according to claim 1, wherein the heat insulation sheet is bent and provided over the door-side flat surface, the compartment inner-side surface and a compartment outer-side surface, the compartment outer-side surface connecting the door-side flat surface and the opening-side surface on an outer side in the width direction in the closed state.

6. The cooling apparatus according to claim 1, wherein the heat insulation sheet is bent and provided over the door-side flat surface, the compartment inner-side surface, the opening-side surface and a compartment outer-side surface, the compartment outer-side surface connecting the door-side flat surface and the opening-side surface on an outer side in the width direction in the closed state.

* * * * *